US005985536A

United States Patent [19]

De Keyzer et al.

[11] Patent Number: 5,985,536

[45] Date of Patent: Nov. 16, 1999

[54] PHOTOSENSITIVE SILVER HALIDE EMULSION CONTAINING A METAL CARBONYL-COMPLEX AS A DOPANT

[75] Inventors: René De Keyzer, Waasmunster, Belgium; Mona Tréguer, Paris, France; Jacqueline Belloni-Cofler, Lozere, France; Hynd Remita, Gif/Yvette, France

[73] Assignee: Agfa-Gevaert, N. V., Mortsel, Belgium

[21] Appl. No.: 09/159,225

[22] Filed: Sep. 23, 1998

[51] Int. Cl.[6] ..... G03C 1/09

[52] U.S. Cl. ..... 430/605; 430/567; 430/569

[58] Field of Search ..... 430/605, 567, 430/569

[56] References Cited

U.S. PATENT DOCUMENTS 4,092,171 5/1978 Bigelow ..... 430/550
5,037,732 8/1991 McDugle et al. ..... 430/567
5,556,742 9/1996 Barlow et al. ..... 430/601

*Primary Examiner*—Mark F. Huff
*Attorney, Agent, or Firm*—Breiner & Breiner

[57] ABSTRACT

A photosensitive element is disclosed comprising on at least one side of a support one or more silver halide emulsion layers and a non-light sensitive hydrophilic colloidal layer characterized in that at least one emulsion layer comprises silver halide crystals having an oligomeric platinum complex containing only carbonyl ligands, which is represented by formula (1):

$$[Pt_3(CO)_6]_n^{2-} \quad (1)$$

wherein n is not more than 10.

The invention also provides a method for the preparation of a photosensitive element as described hereinbefore comprising the step of introducing the oligomeric platinum carbonyl containing complex as represented by formula (1) during grain formation in at least one silver halide emulsion.

8 Claims, No Drawings

PHOTOSENSITIVE SILVER HALIDE EMULSION CONTAINING A METAL CARBONYL-COMPLEX AS A DOPANT

FIELD OF THE INVENTION

The present invention relates to a photosensitive element and method for the preparation of said element. More specifically the invention is related with a photosensitive element with increased photosensitivity.

BACKGROUND OF THE INVENTION

There exists already for a long time a strong and even increasing demand for photosensitive materials that have improved sensitivity, that is for materials that respond to a decreasing amount of light energy. A very interesting possibility is found in photosensitive materials wherein the primary light-activated change exists on an atomic or molecular level which in a secondary step can be multiplicated by several orders of magnitude in order to visualize the first light interaction in the material. This 'two-step' image formation mechanism is for instance encountered in silver halide materials which form the main subject of this invention. It will be clear that sensitivity in this type of materials is determined by the efficiency in which the different steps between the light interaction with the silver halide and the formation of the visual image can proceed. This invention will be specially focused on the way in which the first molecular light-induced change in silver halide crystals is realized. This change on atomic level (also called latent image formation) gives rise to the formation of a visual image after development.

The efficiency of the latent image formation depends on many factors and can therefore be influenced in many different ways. The best result is realized if each photoelectron, created after light absorption in the silver halide crystal reaches the deepest electron trap while forming the latent image. This means that the recombination between holes and electrons that are created after light absorption is as much as possible prevented. Many solutions are proposed but all of them have a limited result. One can primarily try to lower the depth of electron trap in order to increase the capture probability. Chemical sensitization with for instance sulphur, gold, selenium and other compounds or combinations thereof is mostly used for this purpose.

Another way in preventing the recombination of holes and electrons after formation is the temporary interception of these species at local traps with intermediate trap depth. This can be realized by creating a distortion internally in the crystal latice for instance by the local incorporation of an increased amount of iodide in the core or in a certain zone of the grain. Although this method leads to a sensitivity gain by decreasing the electron-hole recombination, another important feature like developability, which is wanted in modern photographic materials is deteriorated by the presence of the iodide. Temporary interceptions of the electron can be realized in many different ways and are described in many patents as for instance in U.S. Pat. No. 2,448,060, EP-A 0 336 425, EP-A 0 336 426, EP-A 0 336 427 and EP-A 0 415 480. In these cases a metal complex dopant was introduced in the silver halide crystals which always resulted in an increased sensitivity. In relation with the present invention special attention is drawn on the electron trapping agents containing CO-ligands. In EP-A 0 415 481 is McDuggle, et al. describing a dopant of the type $[M(CO)_mL_{6-m}]^n$ wherein M is a metal of the $8^{th}$ and $9^{th}$ group of the Periodic System of Elements and L is ligand (halide or others). While m=1, 2 or 3 it can be concluded that always another ligand than the CO-ligand is present in the dopant. Evans et al. describe in U.S. Pat. No. 5,024,931 a metal complex with general formula $M_nX_m$ where M are metals of the $8^{th}$, $9^{th}$ or $10^{th}$ group of the Periodic System of Elements and X represents a halide, pseudo-halide or CO, NO, NS, $N_3$, O or $H_2O$. Further is $4 \leqq m/n < 5$ if $2 < n \leqq 5$, m/n=4 if $6 \leqq n \leqq 8$ and m/n<4 if n>8. JP-A 04-125 629 describes an increase in sensitivity of a chloride-rich AgClBr-emulsion after doping with a metal complex consisting of a metal out of the $7^{th}$ up to $10^{th}$ and the 13th group of the Periodic System of Elements and a ligand which can be a pseudohalide, a carbonyl or another ligand. All the complexes contain one central metal atom except for rhenium. Further JP-A 06-148 784 is describing the doping of a silver halide emulsion with metal-CO-complexes (where the mentioned metals are: Cr, Mo, W and Ru) resulting in an increase of sensitivity.

Increasing the sensitivity of a silver halide emulsion can also be realized by increasing the efficiency of electron transfer from the spectral sensitizer to the silver halide grain which principally can be carried out with a supersensitizer.

Looking at the activity of the sensitizing dye, sensitivity gain can also be realized by decreasing the dye desensitization which is evolved by increasing dye concentration at the grain surface. This can for instance be done by combining an electron donating compound like ascorbic acid with specific cyanine and merocyanine dyes as described in U.S. Pat. No. 4,897,343. An electron-donating compound that is attached to a sensitizing dye or a silver halide absorptive group have also been used to get a additional sensitizing effect as is described in U.S. Pat. No. 5,436,121 and U.S. Pat. No. 5,478,719.

Another interesting alternative to decrease the recombination of the photo-electron and hole is introducing hole traps like silver clusters or some metal complexes in the silver halide crystal. Silver clusters can be created in crystals by reduction sensitization which is realized by treating the emulsion during the precipitation with a reductor like tin compounds, polyamine derivatives, hydrazines, ascorbic acid and analogues, etc. or by well defined pH- and/or pAg-conditions without using reducing substances. This is for instance in U.S. Pat. No. 3,892,574 which describes a method, wherein during precipitation of the silver halide or before or during physical ripening small silver specks (which do not give spontaneously developable fog) are created in reducing conditions. The same can be said for silver halide preparation methods as described in U.S. Pat. No. 3,957,490, where at the end of a reduction periode an oxidant is introduced in the silver halide emulsion before chemical sensitizing. In most of the methods mentioned before it is very difficult to suppress fog formation till an acceptable level which is experienced as a serious problem.

In all the concepts mentioned hereinbefore it is also experienced that these silver clusters can be easily formed on {111}-AgBr crystal faces while it becomes difficult for instance on {100}-AgBr and {100}-AgCl crystal faces. An alternative way for forming silver clusters for this particular application is described in EP-Application Nr. 97/203897.0 (filed Dec. 12, 1997). In this proposal silver halide crystals have to be doped with an organic hole-trapping agent represented by R-COOM as general formula wherein R is H or a substituted or unsubstituted alkyl, aryl or aralkyl, while M is H or any metal or organic group which can form a salt. However alternative hole-trapping agents are still necessary in order to enlarge the number of possibilities to make more sensitive silver halide emulsions. Therefor a new type of platinum clusters is described hereinafter which can act as hole trapping agent.

OBJECTS OF THE INVENTION

It is a first object of the present invention to provide a photosensitive element with improved sensitivity-fog relationship.

It is a further object of the present invention to use a new oligomeric platinum carbonyl-complex as a dopant for silver halide.

It is still a further object of the present invention to provide a photosensitive silver halide emulsion comprising a new oligomeric platinum carbonyl-complex offering an improved sensitivity-fog relationship for said emulsion.

It is even a further object of the present invention to provide a method for the preparation of a photosensitive silver halide emulsion including the step of introducing said oligomeric platinum carbonyl-complex as a dopant.

Further objects and advantages of the invention will become apparent from the description hereinafter.

SUMMARY OF THE INVENTION

The above mentioned objects are realised by a photosensitive element comprising on at least one side of a support one or more silver halide emulsion layers and a non-light sensitive hydrophilic colloidal layer characterized in that the emulsion layer comprises silver halide crystals having an oligomeric platinum complex containing only carbonyl ligands, which is represented by formula (1):

$$[Pt_3(CO)_6]_n^{2-} \quad (1)$$

wherein n is not more than 10.

The invention also provides a method for the preparation of a photosensitive element as disclosed hereinbefore comprising the step of introducing the platinum carbonyl-complex as defined during grain formation in at least one silver halide emulsion.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The present invention concerns the photographic quality of silver halide emulsions, particularly some sensitometric properties like sensitivity and fog. Said photosensitive silver halide emulsions are prepared by precipitation carried out in an aqueous dispersing medium including, at least during grain growth, a peptizer wherein silver ions and halide ions are brought together. Grain structure and properties can be selected by control of several parameters like precipitation temperature, pH, relative proportion of the silver and halide ions in the dispersing medium, etc. In order to avoid fog formation the precipitation is commonly conducted on the halide side of the equivalence point which is defined as 'the point at which the silver and halide ion activity is equal'.

The silver halide emulsions of the current invention are prepared in the presence of compounds which can be occluded in the crystal structure. Such a compound (also called dopant) is replacing an appropiate amount of silver and halide ions in the silver halide lattice. The incorporated metal-complex can be distinguished from the one only present in the emulsion as an additive by EPR- or ENDOR-techniques. The EPR-technique and sample preparation is described in U.S. Pat. No. 5,457,021 by Olm et al. and by H. Vercammen, T. Ceulemans, D. Schoenmakers, P. Moens and D. Vandenbroucke in Proc. ICS&T of 49$^{th}$ Ann. Conf., p. 54 (19–24 May, 1996; Minneanapolis). The description of the ENDOR-technique is given in the same Proc. Ann. Conf., p. 56 by P. Moens, H. Vercammen, D. Vandenbroucke, F. Callens and D. Schoenmakers. These so-called dopants are modifying the crystal structure which on its turn further influences the properties of the crystal. A lot of parameters like sensitivity, gradation, pressure sensitivity, high or low intensity reciprocity failure, stability, dye desensitization, and several other sensitometric aspects of a photosensitive silver halide emulsion can be modified by selection of the dopant, including its concentration, its valency and location in the crystal in case of incorporation of the dopant. When coordination complexes or even oligomeric coordination complexes are used the different ligands bound at the metal ion(s) can be occluded in the crystal lattice too and are in this way influencing the photographic properties of the silver halide material as well (Res. Discl., 38957 (1996) pag 591, section I-D).

Introducing one or more dopants in the silver halide emulsion normally tends to increase the gradation of the image-forming element comprising the said emulsion after subsequent illumination and processing. It is frequently accompanied by a decrease in photographic sensitivity. This characteristic is used advantageously in photosensitive image-forming elements for roomlight or daylight operations. As mentioned already before the location of the dopant can play a significant role and is sometimes even used for fine-tuning of sensitometric characteristics (as for instance described in EP-Application Nr. 97/200585.4, filed Mar. 1, 1997).

The dopant utilized in accordance with the present invention is a platinum complex, represented by the general formula (1):

$$[Pt_3(CO)_6]_n^{2-} \quad (1)$$

wherein n is not more than 10.

Introducing said dopant in the photosensitive silver halide crystals of the present invention leads to an image-forming element with improved sensitivity-fog relationship.

The dopant represented by formula (1) can be produced by irradiation with γ-rays under CO-atmosphere (1 atm. pressure). This synthesis is carried out as follows. The platine carbonyl clusters $Pt_3(CO_6)_{n=3\text{-}10}^{2-}$ were prepared by γ-radiolysis according to a known procedure as described by B. Le Gratiet et al. in Radiat. Phys. Chem., 47(2) 263 (1996). For example, an aqueous solution containing $10^{-3}$ mol/l of $K_2PtCl_6$, in a 50/50 vol % water/2-propanol mixture at a natural pH of 3.4 and at a temperature range from 15° C. to 60° C., was stored in small pyrex flasks, carefully degassed and saturated with carbon monoxyde at atmospheric pressure by bubbling CO through the solutions during 20 minutes (the solution volume was 7 ml; the free gas volume was ca. 7 ml). These samples were subjected to γ-radiolysis ($^{60}$Co source, usual dose rate: 5 kGy.h$^{-1}$) at a dose ranging from 0.2 up to 10 kGy.

The synthesis is selective: the nuclearity n of clusters can be chosen by adjusting the dose (high irradiation dose yields low n value). Thus, different size of platinum clusters can be obtained in a very selective way in a one-step synthesis. For example, to obtain a cluster with a nuclearity of n=10, the applied dose was 0.2 kGy, whereas to obtain a smaller cluster with n=4 the dose applied was 10 kGy.

Such clusters which are well known, were characterized by their UV and visible spectra. The spectrophotometric analysis was carried out on a Varian DMS 100 instrument. The synthesis itself was spectrophotometrically followed to be sure that no other complexes were present. The characteristic absorption maxima together with extinction coefficients are summarized in the following table 1.

TABLE 1

Maximum wavelengths and extinction coefficients for several clusters $Pt_3(CO)_6)^{2-}{}_n$ in a 50/50 vol % $H_2O$/2-propanol mixture.

| n | $\lambda_1$ (nm) | $\epsilon_1 \cdot 10^{-4}$ ($1 \cdot mol^{-1} \cdot cm^{-1}$) | $\lambda_2$ (nm) | $\epsilon_2 \cdot 10^{-4}$ ($1 \cdot mol^{-1} \cdot cm^{-1}$) | Other characteristic IR-Frequencies expressed in ν ($cm^{-1}$) |
|---|---|---|---|---|---|
| 4 | 395 | 3.40 | 615 | 3.84 | 2040vs, 2030sh, 1880mw, 1860s, 1825mw |
| 5 | 410 | 3.90 | 705 | 3.90 | 2055vs, 1890mw, 1870s, 1840mw, 1930sh |
| 6 | 425 | 3.96 | 820 | 4.32 | 2065vs, l900sh, 1875s, 1855sh, 1840sh |
| 7 | 428 | 4.20 | 825 | 4.62 | — |
| 8 | 430 | 4.32 | 860 | 4.56 | — |
| 10 | 435 | 1.50 | 885 | 0.99 | — |

The purity of the dopants was also spectrophotometrically controlled. The presence of other complexes could be detected by the specific absorbtion wavelengths as indicated in the same table (wherein vs=very strong, s=strong, mw=medium weak and sh=shoulder).

As stated before other Pt-carbonyl-complexes represented by formula (1) were synthetized by controlling the irradiation dose while carefully monitoring the spectrophotometric curve (absorption maxima and extinction coefficients) of the irradiated solution in order to get the purity of the complex as desired.

γ-Radiolysis has proved to be very successful in the synthesis of metal clusters and complexes which are often difficult to synthesize by conventional means. The molecular platinum clusters are known to be easily oxydized by air into clusters of the same family with higher nuclearities (Longoni and Chini J. Am. Chem. Soc., 98, 7225 1976). Thus, by introducing a certain complex in a silver halide lattice care has to be taken in order to avoid oxidation of platinum cluster.

The complexes with a nuclearity of n>10 are becoming insoluble in aqueous solutions and start to precipitate so that homogeneous incorporation becomes impossible.

Complications were arising if the deaeration by CO-bubbling was insufficient which resulted in the formation of the so-called 'sub-colloids'. These sub-colloids had a shortage of CO in the complex and did not have the activity of the Pt-carbonyl complexes which satisfy formula (1) of the present invention.

The doping procedure itself can normally be executed at any stage during the grain growth phase of the emulsion preparation where the reactants are added to the reaction vessel in the form of solutions of silver and halide salts or in the form of preformed silverhalide nuclei or fine grains which easily dissolve in the precipitation medium. The dopants can also be added in an indirect way by addition of a dispersion containing very fine soluble silver halide grains or nuclei comprising the dopant. The doping procedure always can start just after ending the nucleation step in order to avoid interference of dopants in the formation of the nuclei. Preferably this corresponds with addition of the said dopants after having precipitated more than 1% of silver halide, more preferably more than 3% and most preferably more than 5%. This means that said dopant can be present in the shell of the emulsion grains containing up to 95% of the precipitated silver halide. On the other side the shell containing said dopant have to be present underneath the grain surface but at a distance d which is at least more than 0.01 μm, preferably more than 0.005 μm and most preferably more than 0.001 μm.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing or fluctuating rate, if desired in combination with stepwise delivery procedures. More details about the possible ways in making a silver halide emulsion which can be principally used in practizising this invention are summarized in Res. Discl., 38957 (1996) 591–639 section I-C.

Special attention has to be paid to the way the dopant is introduced during the grain growth process. The stability of the metal ligand complex in the solution can be very limited. Therefore the solution containing the dopant is preferentially introduced via a third jet, in a zone in the reactor where the compounds are rapidly incorporated in the growing microcrystals. The advantage of using a third jet is that a solvent can be used which is most suitable for the stability of the given dopant. Further the temperature of the dopant solution can be adjusted in order to maximize the stability too. As mentioned already before the most stable conditions for the dopant solution has to be tested, for instance, by UV-VIS absorption. The third jet itself can be adjusted automatically or manually. The dopant can be added at a constant rate or at any rate profile as for instance in JP-A 03 163 438 wherein the dopant is occluded in two different concentrations in the silver halide grains of a direct positive emulsion having the highest concentration closest to the grain centre.

Besides the dopants of the present invention represented by formula (1) other dopants can be added to the silver halide emulsion. These are essentially introduced because of their specific influence on the photographic characteristics. Different classes of dopants are known like for instance dopants (such as $IrCl_6^{3-}$) resulting in a non-permanent electron trapping behaviour which can be a shallow electron trap (such as $Ru(CN)_6^{2-}$) (see Res. Discl., 36736 (1994) 657.), or a deep elctron trapping center (e.g. $RuCl_5(NO)^{2-}$ or $RhCl_6^{3-}$). Many examples of this category have already been described in the patent literature but cover different silver halide systems like those mentioned in WO 92/16876, EP-A 0 264 288, EP-A 0 552 650 and EP-A 0 752 614.

The photographic emulsions prepared in this way contain silver halide crystals comprising chloride, bromide or iodide alone or combinations thereof. Other silver salts which can be incorporated in a limited amount in the silver halide lattice are silver phosphate, silver thiocyanate, silver citrate and some other silver salts. The chloride and bromide halide can be combined in all ratios to form a silverchlorobromide salt. Iodide ions however can be coprecipitated with chloride and/or bromide ions in forming a iodohalide with an iodide amount which depends on the saturation limit of iodide in the lattice with the given halide composition; this means up to a maximum amount of about 40 mole percent in silver iodobromide and up to at most 13 mole percent in silver iodochloride both based on silver.

The present invention is suitable for an application in high speed camera-films, in radiographic materials, in graphic art films, in color paper and in others. Therefore a great variety of halide combinations should be covered. However for the chloride containing silver halides as AgClBrI, AgClI and AgClBr the prefered chloride concentration is at least 10 mol % and most prefered not less than 50 mol % which conditions are also encountered in many other silver halide photographic systems like those which are described e.g. in EP-A 0 264 288 and EP-A 0 752 614.

The composition of the halide can change in the crystal in a continous or discontinous way. Emulsions containing crystals composed of various sections with different halide compositions are used for several photographic applications. Such a structure with a difference in halide composition between the center and the rest of the crystal (what is called 'core-shell'-emulsion) or with more than two crystal parts differing in halide composition (called a 'band'-emulsion) may occur. The changes in halide composition can be realised by direct precipitation or in an indirect way by conversion where fine silver halide grains of a certain halide composition are dissolved in the presence of the so-called host grains forming a 'shell' or 'band' on the given grain.

The emulsions can include silver halide grains of any conventional shape or size. Specifically the emulsions can include coarse, medium or fine silver halide grains. The silver halide emulsions can be either monodisperse or polydisperse after precipitation. The crystals formed by the methods described hereinbefore can therefor have a morphology which is tabular, or non-tabular like cubic, octahedral, etc. In tabular crystals the aspect ratio (ratio of equivalent circular diameter to thickness) can vary from low (<2) over 'medium' (2 till 8) to high (>8) where specially in the case of the ultra thin tabular crystals high aspect ratios can be realised. The major faces of the formed tabular grains can have a {111} or a {100}-habitus the structure of which is (respectively) stable or has to be stabilised (for instance by a 'habitus modifying agent'). In the class of non-tabular grains there are a lot of crystal structures possible which can be divided in the more regular shaped crystals or the crystals with a mixed crystal habit.

The present invention is applicable to crystals comprising any combination of halides which can even occasionally exist together with other silver salts as mentioned above. It is important to note that physical grain structures with two or more different halide compositions in one crystal can be used in combination with partially doping in each part of the emulsion crystals. This means that for instance an internally doped crystal can match more than one crystal part with different halide compositions.

After precipitation the emulsions can be coagulated and washed in order to remove the excess soluble salts. These procedures are together with different alternative methods like dia- or ultrafiltration and ion-exchange described in Res. Discl., 38957 (1996), section III. The silver halide emulsions of this invention which are prepared in one of the ways described hereinbefore contain crystals which have a spherical equivalent diameter (SED) of not more than 1.0 $\mu$m but preferable less than 0.5 $\mu$m. The spherical equivalent diameter (SED) of the crystal represents the diameter of the sphere which has the same volume as the average volume of the silver halide crystals of the said emulsion.

The emulsions can be surface-sensitive emulsions which form latent images primarily on the surface of the silver halide grains or they can be emulsions forming their latent-image primarily in the interior of the silver halide grain. Further the emulsions can be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

The silver halide emulsions can be surface-sensitized by chemical sensitization which can be done in many different ways, in presence of a chalcogen as sulfur, selenium or tellurium, in presence of a noble metal as for instance gold or in combination with a chalcogen and noble metal. In a particular embodiment a sulphur sensitizer can be added in form of a dispersion of solid particles as has been described in EP-A 0 752 614. Chemical sensitization can also be carried out by reduction sensitization if desired combined with the chalcogen/noble metal-sensitization. The presence of certain 'modifying' agents as for instance spectral sensitizers which can optimize the chemical sensitization process are often used. A complete description of all the different possibilities with respect to this subject can be found in Res. Discl., 38957 (1996), section IV.

In a next step the silver halide emulsions can be spectrally sensitized with dyes from different classes which include polymethine dyes comprising cyanines, merocyanines, tri-, tetra- and polynuclear cyanines and merocyanines, oxanols, hemioxanols, styryls, merostyryls and so on. Sometimes more than one spectral sensitizer may be used in the case that a larger part of the spectrum has to be covered. Combinations of several spectral sensitizers are sometimes used to get supersensitization, which means that in a certain region of the spectrum the sensitization is greater than the sum of the individual sensitization effects of both dyes concerned. Generally supersensitization can be attained by using selected combinations of spectral sensitizing dyes and other addenda such as stabilizers, development accelerators or inhibitors, brighteners, coating aids, and so on. A good description of all the possibilities in spectral sensitization which are important with respect to this invention can be found in Res. Discl., 38957 (1996) section V.

In the case that desensitizers should be used, as for instance in pre-fogged direct-positive or in daylight handling materials, various chemical compounds are proposed for practical use. Principally all these compounds which are used as desensitizers in silver halide materials and which are for instance summarized in EP-A 0 477 436 can be used in combination with the elements of this invention.

The photographic elements comprising the said silver halide emulsions can include various compounds which should play a certain role in the material itself or afterwards in the processing, finishing or warehousing the photographic material. These products can be stabilizers and anti-foggants (see Res. Discl., 38957 (1996) section VII), hardeners (see Res. Discl., 38957 (1996) section IIB), brighteners (see Res. Discl., 38957 (1996) section VI), light absorbers and scattering materials (see Res. Discl., 38957 (1996) section VIII), coating aids (see Res. Discl., 38957 (1996) section IXA), antistatic agents (see Res. Discl., 38957 (1996) section IXC), matting agents (see Res. Discl., 38957 (1996) section IXD) and development modifiers (see Res. Discl., 38957 (1996) section XVIII). The silver halide material can also contain different types of couplers, which can be incorpated as described in Res. Discl., 38957 (1996) section X.

The photographic elements can be coated on a variety of supports as described in Res. Discl., 38957 (1996) section XV and the references cited therein. The photographic elements can be exposed to actinic radiation, specially in the visible, near-ultraviolet and near-infrared region of the spectrum, to form a latent image (see Res. Discl., 38957 (1996) section XVI).

This latent-image can be processed in order to form a visible image (see Res. Discl., 38957 (1996) section XIX). If applications in the context of the present invention are focussed on Cl-containing photosensitive silver halide materials, automatic processing is advantagely used in order to get rapid and convenient processing. In order to prevent the disadvantages (as for instance the formation of silver sludge) of automatic processing these materials a preferred method of processing is described in EP-A 0 732 619. The developer mentioned in the last reference contains a combination of hydrochinon, an auxiliary developing agent, ascorbic acid or one of its isomers or derivatives, and a small amount of a thiocyanate salt. In more general terms this has already been described for silver halide systems as those mentioned e.g. in EP-A 0 552 650 and EP-A 0 752 614. But it is recommended to apply the method and to use the various ascorbic acid analogues as described in EP-A 0 732 619, which is incorporated herein by reference.

Processing to form a visible dye image for colour materials means contacting the element with a colour developing agent in order to reduce developable silver halide and to oxidize the colour developing agent which in turn normally reacts with the coupler to form a dye (see Res. Discl., 38957 (1996) section XX).

Having described in detail preferred embodiments of the current invention, it will now be apparent to those skilled in the art that numerous modifications can be made therein without departing from the scope of the invention as defined in the claims mentioned hereinafter.

The invention can be better appreciated by reference to the following specific examples. They are intended to be illustrative and not exhaustive about the requirements of the invention as described herinbefore and as summarized in the claims nailing on to the essentials of this invention. The present invention, however, is not limited thereto.

EXAMPLES

The examples described hereinafter will clearly illustrate the advantages which can be realized by incorporating the platinum carbonyl complex as described in the present invention.

For the preparation of the core-shell emulsions which are used in the next examples the following solutions were prepared:

- solution (1): containing 500 grams of silver nitrate in 1 liter of demineralized water;
- solution (2a): containing 231.6 grams of sodium chloride in 1 liter demineralized water;
- (2b): containing 349.9 grams of potassium bromide in 1 liter of demineralized water;
- solution (3): containing 75 grams of an inert gelatine in 1.5 liter demineralized water.
- solution (4): containing $10^{-3}$ mol/l of a $[Pt_3(CO)_6]_n^{2-}$ complex in a 50/50 vol % water/2-propanol mixture.

Example 1

Application of $[Pt_3(CO)_6]_6^{2-}$ as Dopant in a Silver Bromide Emulsion

Preparation of the Emulsions (a) Nucleation Phase

After raising the temperature of solution (3) to 50° C. the pAg was adjusted to 7.4 with a 2.94 molar silver nitrate solution and the pH to 2.8 with a 1 molar sulphuric acid solution. Then the solutions (1) and (2b) were introduced during 300 seconds into solution (3) by using the double jet precipitation technique with a flow rate of 7.75 ml per minute while keeping the pAg constant at 7.4.

(b) Growth Phase—$1^{rst}$ Step

Then the double jet precipitation was continued by introducing the solutions (1) and (2b) during 2888 seconds in the foregoing precipitate which was kept at 50° C. The flow rate was then linearly increased from 7.75 ml per minute at the start till 60 ml per minute at the end of the precipitation while keeping the pAg always at 7.4.

The emulsion was then ultrafiltrated on a selective permeability membrane for salts and water while keeping the pAg at the same value of 7.4. After filtration the emulsion was further peptized and stored for a short time. An inert type of gelatine was then added in order to bring the emulsion on a gelatin to silver ratio of 0.5 (where silver was expressed as silver nitrate) which was followed by a short periode of stirring to get a good gelatin dispersion and the addition of a small amount of a phenolic solution to avoid rotting.

The emulsion made in this way contained monodisperse cubic grains with a mean volumetric diameter of 0.37 μm. After adding 500 ml of demineralized water to 650 grams of the emulsion the amount of silver nitrate was 85 gram per kilogram of the emulsion, the temperature was raised to 50° C., the pAg was raised to 7.3 and the pH adjusted to 2.8 with a 1 molar sulphuric acid solution.

(c) Growth Phase—$2^{nd}$ Step

In this precipitation step a triple jet procedure was followed wherein the thickness of the shell was as close as possible to 50 nm so that the total mean volumetric grain thickness was 0.42 μm. The three solutions (1), (2b) and (4) were injected together in the diluted core-emulsion so that the silver nitrate solution (1) had a constant flow rate of 20 ml per minute during 450 seconds while keeping the pAg adjusted at 7.3. Solution (4) was added only 375 seconds (same start moment) with a flow rate of 8 ml per minute, which was kept constant during the precipitation step.

After the precipitation step the emulsion was washed by flocculation in order to remove the remaining salts. Therefor the emulsion was cooled and the pH was adjusted at 3.4. Then flocculation was started by slowly adding polystyrenesulphonate to the solution under firmly stirring. After sedimentation the water and the salts above the precipitate was removed and demineralized water was added in order to repeat the same washing cycle twice again. In the next step the weight ratio of gelatine over silver nitrate was adjusted to 0.5 by adding the same type of inert gelatine. The resulting emulsion contained 140 grams of silver nitrate per kilogram.

(d) Chemical Sensitization

The emulsions were then redispersed and diluted with demineralized water and after adjusting the pAg and pH respectively to 7.15 and 5.5 at the temperature of 50° C. the following compounds were added (per 500 gram of silver nitrate):

- 2.8 ml of a diluted surfactant solution and 3.5 ml of a $2.5\times10^{-5}$ molar solution of sodium p-toluenethiosulphonic acid which after 13 minutes was sequentially followed by
- 0.84 ml of a $8\times10^{-6}$ molar sodium thiosulphate solution,
- 1.75 ml of a solution containing $1.456\times10^{-3}$ mole/l $AuCl_4.4H_2O$ and $1.58\times10^{-2}$ mole/l $NH_4CNS$,
- 2.10 ml of a 0.396 molar solution of sodium sulphite.

The chemical sensitization was carried out till an optimal sensitivity was reached.

(e) Coating Procedure

After cooling to 40° C. the chemically sensitized emulsion was adjusted at a weight ratio of gelatine over silver nitrate of 1.0. Then a well defined amount of a triazaindolizine derivative for stabilization and several wetting agents were added before coating the emulsion on a polyethylene terephtalate support. The amount of silver nitrate was 1.5 grams per $m^2$.

(f) Exposure and Processing

The coated emulsions were then exposed during $10^{-2}$ seconds through a step wedge (constant=0.15) and a band filter (of 405 nm) with a XENON-lamp. The development was carried out in a G150-bath during 1 minute, followed by a 1 minute fixation step in a G333-bath (which was diluted with 4 parts of water for one part G333) and a 1 minute washing step in demineralized water. All the processing steps were carried out at room temperature. G150 and G333 are tradenames of AGFA-GEVAERT. The density which was realized after processing as a function of the light dose was measured and used to determine the following parameters:

the fog level $D_{min}$, the maximum density $D_{max}$, the sensitivity $S_{0.1>fog}$ is measured as the amount of light (expressed in log(It)-units) necessary to get a density of 0.1 above fog level, the sensitivity $S_{0.5>fog}$ is measured as the amount of light (expressed in log(It)-units) necessary to get a density of 0.5 above fog level; the sensitivity value of $S_{0.1>fog}$ and $S_{0.5>fog}$ means that a decrease of 0.3 is a sensitivity increase by a factor 2;

the contrast is measured as the slope of the sensitometric curve between 25 and 75% of the $D_{max}$-value in the curve, the amount of the $[Pt_3(CO)_6]_6^{2-}$-complex, expressed in mole per mole of silver halide, is realized by varying the concentration of the complex solution and maintaining the same introduction periode of 375 seconds. The results summarized in Table 1.1 show very clearly that chemical sensitized silver bromide emulsions which are doped with the platinum carbonyl complex according to formula (1) of the present invention improve in sensitivity without increase in fog.

TABLE 1.1

Comparative study of sensitized AgBr-emulsions doped with various concentrations of Pt—CO clusters

| Photographic material | $D_{min}$ | $D_{max}$ | Sens $S_{0.1>fog}$ | Sens $S_{0.5>fog}$ | Contrast |
|---|---|---|---|---|---|
| AgBr Reference | 0.03 | 1.18 | 3.10 | 3.52 | 1.02 |
| AgBr 0.1 ppm $[Pt_3(CO)_6]_6^{2-}$ | 0.03 | 1.23 | 3.07 | 3.49 | 0.97 |
| AgBr 1 ppm $[Pt_3(CO)_6]_6^{2-}$ | 0.04 | 1.20 | 2.99 | 3.39 | 0.99 |
| AgBr 5 ppm $[Pt_3(CO)_6]_6^{2-}$ | 0.04 | 1.17 | 2.94 | 3.36 | 0.98 |
| AgBr 10 ppm $[Pt_3(CO)_6]_6^{2-}$ | 0.03 | 1.18 | 2.55 | 3.04 | 0.94 |
| AgBr 100 ppm $[Pt_3(CO)_6]_6^{2-}$ | 0.03 | 1.29 | 2.29 | 2.85 | 0.75 |

Example 2

Application of $[Pt_3(CO)_6]_6^{2-}$ as Dopant in a Silver Halide Emulsions

Preparation of the Emulsions (a) Nucleation and $1^{rst}$ Growth Phase

These steps for the preparation of the silver bromide and the silver chloride as well were identical with those described in example 1. This included the ultrafiltration as washing step too.

(b) The $2^{nd}$ Growth Step

For the silver bromide emulsions the same procedure had been followed as in example 1.

For the silver chloride emulsions the solutions (1), (2a) and (4) were injected together in the core emulsion made in the first step. Therefor solution (1) was added with a constant flow rate of 30 ml/minute during 316 seconds while keeping the pAg-value at 7.3. Solution (4) was added only 300 seconds (same start moment) with a constant flow rate of 10 ml/minute. The same dopant as in example 1 was used for doping the emulsions in this experiment.

(c) Chemical sensitization, coating, exposure and processing were identical with the procedures used in example 1. The results are summarized in Table 2.1.

TABLE 2.1

Comparative study between undoped and doped AgC1 and AgBr emulsions after chemical sensitization.

| Photographic material | $D_{min}$ | $D_{max}$ | Sens $S_{0.1>fog}$ | Sens $S_{0.5>fog}$ | Contrast |
|---|---|---|---|---|---|
| AgCl Reference | 0.03 | 0.71 | 3.34 | 3.55 | 1.10 |
| AgCl 10 ppm $[Pt_3(CO)_6]_6^{2-}$ | 0.04 | 0.80 | 3.16 | 3.37 | 0.93 |
| AgCl 100 ppm $[Pt_3(CO)_6]_6^{2-}$ | 0.05 | 0.73 | 2.64 | 3.05 | 0.87 |
| AgBr Reference | 0.03 | 1.02 | 2.32 | 2.70 | 1.06 |
| AgBr 10 ppm $[Pt_3(CO)_6]_6^{2-}$ | 0.04 | 1.20 | 1.92 | 2.59 | 0.85 |
| AgBr 10 ppm $[Pt_3(CO)_6]_6^{2-}$ | 0.06 | 1.02 | 1.46 | 2.35 | 0.79 |

As can be seen from these results the incorporation of a dopant represented by formula (1) of the present invention in a silver halide emulsion gives a spectacular increase in sensitivity with only a very small tendency of fogging. This effect which is largest for the most sensitive emulsion grains can already be realized with small quantities of dopants, specially in the silver bromide emulsions.

Example 3

The Activity of $[Pt_3(CO)_6]_n^{2-}$ Dopant Incorporated in Silver Halide as a Function of its Nuclearity These experiments were carried out in silver bromide emulsions which were made in an identical way as in example 1. The results are summarized in Table 3.1.

With the results shown in table 3.1 it is demonstrated that the incorporation of the complex represented by formula (1) of the present invention as a dopant in a silver bromide emulsion gives a sensitivity increase which is almost independant of the nuclearity of said complex.

TABLE 3.1

Comparative study of AgBr emulsion doped with Pt-carbonyl complexes of various nuclearity (n = 4–10)

| Photograpic material | $D_{min}$ | $D_{max}$ | Sens $S_{0.1>fog}$ | Sens $S_{0.5>fog}$ | Contrast |
|---|---|---|---|---|---|
| AgBr Reference | 0.03 | 1.18 | 3.10 | 3.52 | 1.02 |
| AgBr 10 ppm $[Pt_3(CO)_6]_4^{2-}$ | 0.03 | 1.23 | 2.45 | 2.84 | 0.83 |
| AgBr 10 ppm $[Pt_3(CO)_6]_5^{2-}$ | 0.04 | 1.20 | 2.59 | 3.06 | 0.89 |
| AgBr 10 ppm $[Pt_3(CO)_6]_6^{2-}$ | 0.03 | 1.18 | 2.55 | 3.04 | 0.94 |
| AgBr 10 ppm $[Pt_3(CO)_6]_8^{2-}$ | 0.03 | 1.18 | 2.56 | 3.06 | 0.91 |
| AgBr 10 ppm $[Pt_3(CO)_6]_{10}^{2-}$ | 0.03 | 1.29 | 2.50 | 2.99 | 0.75 |

Example 4

The Influence of the Position of the Pt-Carbonyl Dopant on its Activity in a Silver Halide Emulsion These experiments were carried out in silver bromide emulsions which were made in an identical way as in example 1. The only difference is the procedure for the addition of the dopant in the $2^{nd}$ growth step which was carried out as follows. The addition of the dopant itself was always carried out during the second growth phase with a flow rate of 20 ml/minute, while the amount was in each experiment identical (namely 10 ppm of $[Pt_3(CO)_6]_4^{2-}$, expressed as mole per mole of silver halide). The start-moment wherein the complex was added, changed each experiment. The reference in this experiments was an emulsion without the Pt-carbonyl complex as dopant. The indicated position of the $[Pt_3(CO)_6]_4^{2-}$-dopant in the precipitated shell of the emulsion grains is expressed as the percentage of the shell volume situated between the moment where the addition via the third jet was started and the moment where the addition was stopped. The results are summarized in Table 4.1.

These results about the influence of the localization of the dopant of the present invention on the photographic sensitivity are demonstrating that the position of the dopant is essential.

TABLE 4.1

Comparative study of AgBr emulsion doped with 10 ppm of $[Pt_3(CO)_6]_6^{2-}$—clusters localized on or under the surface

| Photographic material | $D_{min}$ | $D_{max}$ | Sens $S_{0.1>fog}$ | Sens $S_{0.5>fog}$ | Contrast |
|---|---|---|---|---|---|
| AgBr Reference | 0.03 | 1.18 | 3.10 | 3.52 | 1.02 |
| AgBr 65–100% | 0.03 | 1.15 | 3.00 | 3.46 | 0.97 |
| AgBr 40–75% | 0.04 | 1.23 | 2.60 | 3.05 | 0.90 |
| AgBr 0–35% | 0.03 | 1.18 | 2.56 | 3.06 | 0.91 |

It shows that the dopant has to be incorporated under the grain surface while the presence at the surface eleminates the positive effect.

We claim:

1. A photosensitive element comprising on at least one side of a support one or more silver halide emulsion layer(s) and a non-light sensitive hydrophilic colloidal layer characterized in that at least one emulsion layer comprises silver halide crystals having an oligomeric platinum complex containing only carbonyl ligands, which is represented by formula (1):

$$[Pt_3(CO)_6]_n^{2-} \quad (1)$$

wherein n is not more than 10.

2. A photosensitive element according to claim 1, wherein the platinum complex according to formula (1) is present in an outermost shell of the silver halide crystals.

3. A photosensitive element according to claim 2, wherein said outermost shell contains not more than 95% of the silver present in each crystal.

4. A photosensitive element according to claim 2, wherein said platinum complex is present in the outermost shell at least a distance of 0.01 $\mu$m or more under the grain surface.

5. A photosensitive element according to claim 1, wherein the platinum complex according to formula (1) is present in an amount of from $10^{-9}$ up to $10^{-4}$ mole per mole of silver halide.

6. A photosensitive element according to claim 1, wherein the silver halide is composed of at least one halide selected from the group consisting of chloride, bromide and iodide.

7. A photosensitive element according to claim 1, wherein said silver halide contains one or more additional dopant(s) being different from the platinum complex according to formula (1).

8. A method of preparing a photosensitive element according to claim 1 comprising the step of introducing the oligomeric platinum complex according to formula (1) during grain formation of silver halide crystals of at least one silver halide emulsion to be coated in one or more silver halide emulsion layers.

* * * * *